US010624451B2

(12) United States Patent
Bhattacharya

(10) Patent No.: US 10,624,451 B2
(45) Date of Patent: Apr. 21, 2020

(54) THERAPY DESK

(71) Applicant: Amor Bhattacharya, Little Elm, TX (US)

(72) Inventor: Amor Bhattacharya, Little Elm, TX (US)

( * ) Notice: Subject to any disclaimer, the term of this patent is extended or adjusted under 35 U.S.C. 154(b) by 0 days.

(21) Appl. No.: 16/236,709

(22) Filed: Dec. 31, 2018

(65) Prior Publication Data

US 2020/0077787 A1 Mar. 12, 2020

Related U.S. Application Data

(60) Provisional application No. 62/729,546, filed on Sep. 11, 2018.

(51) Int. Cl.

| | |
|---|---|
| ***A47B 21/02*** | (2006.01) |
| ***A47B 83/04*** | (2006.01) |
| ***A47B 9/16*** | (2006.01) |
| ***A47B 21/04*** | (2006.01) |
| ***A63B 23/14*** | (2006.01) |
| ***A63B 23/035*** | (2006.01) |
| ***A63B 21/012*** | (2006.01) |
| ***A63B 21/00*** | (2006.01) |
| ***A63B 23/16*** | (2006.01) |

(52) U.S. Cl.

CPC ..... *A47B 21/02* (2013.01); *A47B 9/16* (2013.01); *A47B 21/04* (2013.01); *A47B 83/045* (2013.01); *A63B 21/00181* (2013.01); *A63B 21/012* (2013.01); *A63B 23/03575* (2013.01); *A63B 23/14* (2013.01); *A63B 23/16* (2013.01); *A47B 2200/004* (2013.01); *A63B 2210/00* (2013.01); *A63B 2225/093* (2013.01)

(58) Field of Classification Search

USPC ..... 108/145, 147, 50.01, 50.02, 116, 117, 108/118, 144.11; 248/920; 254/126

See application file for complete search history.

(56) References Cited

U.S. PATENT DOCUMENTS

| | | | | | |
|---|---|---|---|---|---|
| 490,127 | A * | 1/1893 | Sigafoos | A47B 21/02 | 312/27 |
| 755,706 | A * | 3/1904 | Schellenbach | A47B 9/00 | 108/145 |
| 2,645,538 | A * | 7/1953 | Segal | A47B 9/00 | 108/145 |
| 3,160,228 | A * | 12/1964 | De Witt Steed | E04G 1/22 | 182/148 |
| 3,917,211 | A * | 11/1975 | Daunderer | B60N 2/161 | 248/421 |
| 4,025,054 | A * | 5/1977 | Yamazaki | B66F 3/12 | 254/126 |
| 4,055,329 | A * | 10/1977 | Hammond | B66F 3/12 | 254/424 |

(Continued)

*Primary Examiner* — Jose V Chen

(74) *Attorney, Agent, or Firm* — Dunlap Bennett & Ludwig PLLC; Brendan E. Squire

(57) ABSTRACT

A therapy desk and desk tops provide various therapies to the users while standing up or sitting down. It is configured to provide therapeutic benefits by two knobs that are rotated by hand to elevate and lower the desktop or the desk, providing excellent therapy to fingers, wrists, hands, back and legs. As it is operated while sitting down it avoids strain to the back. Also the peddling device used while sitting down provides excellent therapy to the legs.

11 Claims, 8 Drawing Sheets

(56) References Cited

U.S. PATENT DOCUMENTS 4,315,466 A 2/1982 Boerigter
4,589,621 A * 5/1986 Hunt ..... F16M 11/10 248/421
4,604,955 A * 8/1986 Fleischer ..... A47B 9/04 108/106
4,865,403 A 9/1989 Steinhilber
4,943,034 A * 7/1990 Wagnon ..... B66F 3/12 254/122
4,974,915 A 12/1990 Bussard
5,101,736 A 4/1992 Bommarito et al.
D340,566 S * 10/1993 Thomas ..... D34/28
5,257,701 A 11/1993 Edelson
5,314,392 A 5/1994 Hawkins et al.
5,408,940 A 4/1995 Winchell
5,437,235 A * 8/1995 Randolph ..... A47B 21/00 108/25
5,526,756 A 6/1996 Watson
5,694,864 A * 12/1997 Langewellpott ..... B66F 7/0608 108/145
6,062,147 A 5/2000 Footitt et al.
6,298,794 B1 10/2001 Brown et al.
6,595,144 B1 7/2003 Doyle
7,677,518 B2 * 3/2010 Chouinard ..... A47B 21/02 108/10
7,757,998 B1 7/2010 Fidali et al.
7,789,025 B2 9/2010 Michaud, II et al.
7,849,789 B1 * 12/2010 Whelan ..... A47J 47/005 108/116
8,276,525 B2 10/2012 Janssen
8,342,462 B2 1/2013 Sapper et al.
8,602,391 B2 * 12/2013 Milicic ..... B66F 3/12 254/100
8,662,605 B2 * 3/2014 McRorie ..... B62B 3/02 108/38
8,870,284 B2 * 10/2014 Chapman ..... B60N 2/265 297/256.11
8,919,264 B1 12/2014 Lager
9,596,929 B2 * 3/2017 Koulizakis ..... A47B 83/02
9,681,746 B1 * 6/2017 Chen ..... A47B 9/02
9,757,611 B1 9/2017 Colburn
10,114,352 B2 * 10/2018 Matlin ..... A47B 9/16
10,159,336 B2 * 12/2018 Liao ..... A47B 9/16
2002/0108544 A1 8/2002 Hsu
2004/0040480 A1 * 3/2004 Hwang ..... A47B 3/02 108/145
2006/0249057 A1 * 11/2006 Meyer ..... B25H 1/14 108/50.01
2007/0034125 A1 * 2/2007 Lo ..... B66F 7/0608 108/145
2007/0151489 A1 7/2007 Byrne
2012/0174833 A1 7/2012 Early et al.
2015/0289641 A1 * 10/2015 Ergun ..... A47B 9/16 108/42

* cited by examiner

THERAPY DESK

CROSS-REFERENCE TO RELATED APPLICATION

This application claims the benefit of priority of U.S. Provisional application No. 62/729,546, filed Sep. 11, 2018, the contents of which are herein incorporated by reference.

BACKGROUND OF THE INVENTION

The present invention relates to desktops and desks, and more particularly to true vertically adjustable therapeutic desks and desktops.

Current adjustable desktops and desks are limited to simply providing a somewhat non-vertical up and down adjustments of the surfaces of these devices. In manual configurations, the user has to stand up, lean or bend over, and pull up to raise the desktop to the desired height. In addition, these actions will require the user to step back to allow the desktop to come forward taking up most of the space of the desk. The monitor and the keyboard board are placed on the devices when the desired height is set. To lower it, the user has to unlatch and push down the device. These prior art adjustable devices are heavy and cumbersome, often requiring two people to set up.

These prior art adjustable devices do not provide any therapy except allowing the user to stand up and sit down. None of these provide any therapy and exercises to the fingers, wrists, hands, back and legs.

Thus, there is a definite need for improved therapeutic desks and desktops that provides excellent therapy to fingers, wrists, hands, back and legs while avoiding any strain to the back, hands, wrists caused by leaning, bending, pulling and pushing down of these devices as required by the prior art.

SUMMARY OF THE INVENTION

In one aspect of the present invention a therapeutic desktop, for supporting one or more monitors is disclosed. The therapeutic desktop includes a desktop surface for supporting the one or more monitors. An elevation mechanism supports a left side and a right side of the desktop surface. An elevation knob is connected to the elevation mechanism. The elevation knob is rotatable by a user's hand to selectively elevate or lower the elevation mechanism.

The elevation mechanism may include a scissors assembly having a base disposed for contact with a support surface. A top connector connects the scissors assembly to a bottom face of the desktop surface. The elevation knob is connected to a worm screw of the scissors assembly. The scissors assembly may include a pair of opposed lower legs having a first end pivotally attached to the base. A pair of opposed upper legs having a first end that are pivotally connected a bottom of the desktop surface.

A joint pivotally connects a second end of the pair of opposed lower legs with a corresponding second end of the pair of opposed upper legs. A threaded aperture in the joint receives the worm screw. Rotation of the elevation knob rotates the worm screw to selectively draw or extend the joints together or away from each other.

In some embodiments, a coupler is provided on the elevation knob and is configured to connect with a rotary drive motor. The rotary drive motor may be a rechargeable cordless drill/driver tool.

In other embodiments, the therapy desk may also include a keyboard support providing an upper working surface to support a computing keyboard and mouse. The working surface may be elevated by a side edge. The working surface may also include a mouse surface. Adjustable legs may selectively raise and lower the keyboard support independent of the monitor stand.

In yet other embodiments, the therapeutic desktop may include a desk pedestal having a left drawer structure and a right drawer structure. The elevation mechanism may be carried within a top drawer cavity of the desk pedestal. A faceplate of the top drawer cavity is selectively positioned to access or conceal the elevation mechanism. The elevation knobs are disposed such that a user can reach each elevation knob while positioned in front of the therapeutic desktop.

In yet other embodiments, the therapeutic desktop may include a stand having a plurality of upright frame members. A base interconnects the plurality of upright frame members. A platform interconnects the plurality of upright frame members below a top end of the plurality of upright frame members. The elevation mechanism is carried by the platform and the desktop surface rests upon the ends of the plurality of upright frame members with the elevation mechanism in a lowered position. A ground wheel may also be attached to each of the plurality of upright frame members.

These and other features, aspects and advantages of the present invention will become better understood with reference to the following drawings, description and claims.

DETAILED DESCRIPTION OF THE INVENTION

Figure 1:
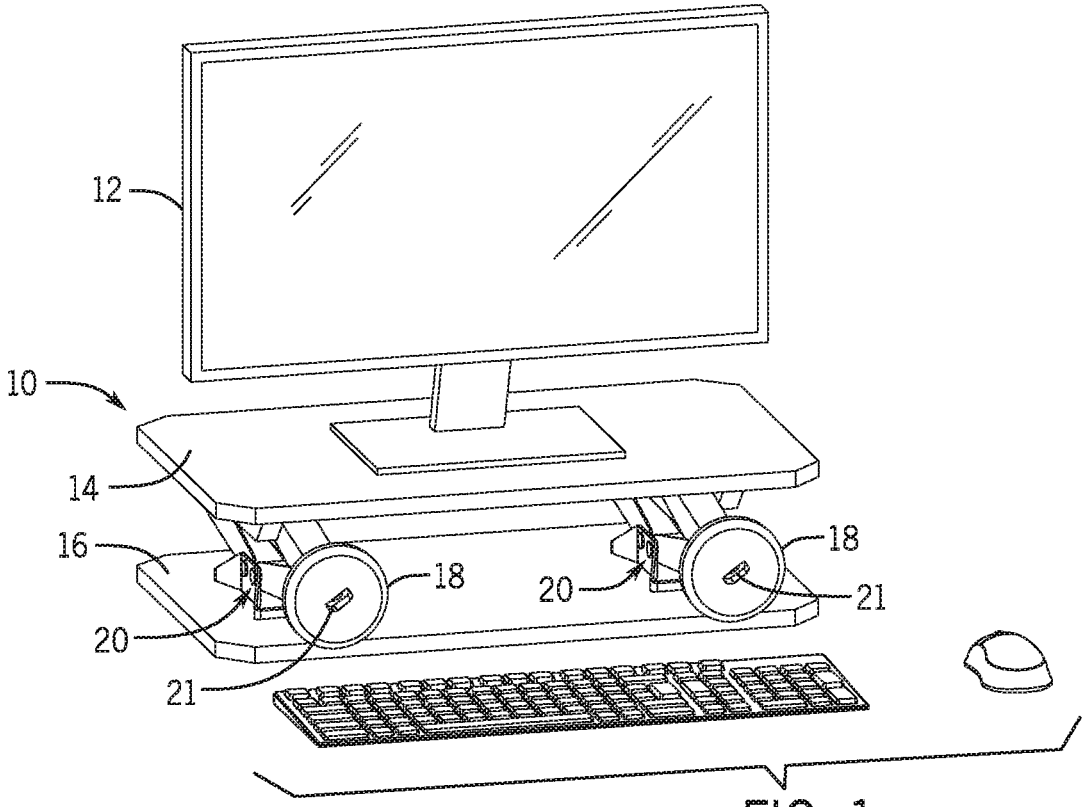
FIG. 1 is a front perspective view of the therapy desk desktop in a lowered position.
Figure 2:
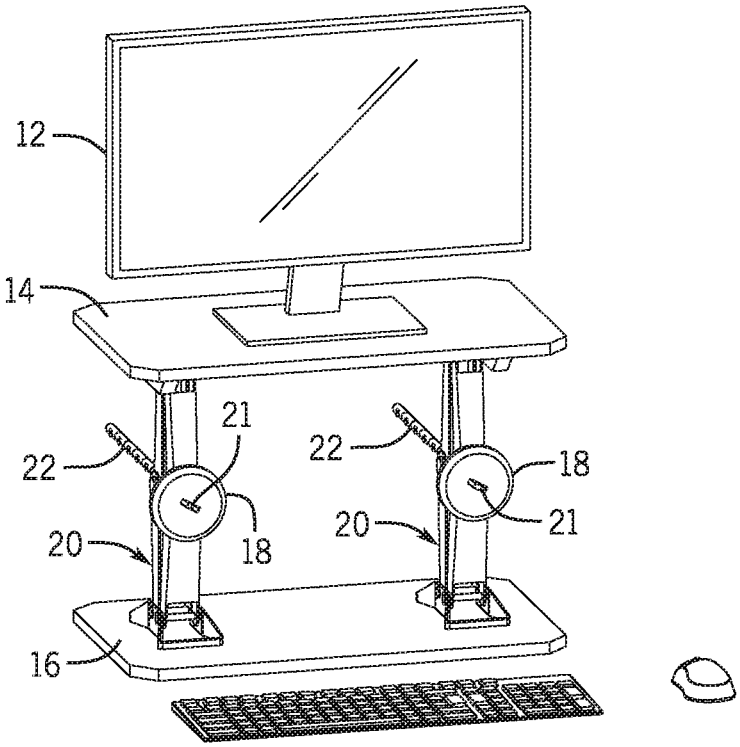
FIG. 2 is a front perspective view showing the same in an elevated position manually or power drive attachment.
Figure 3:
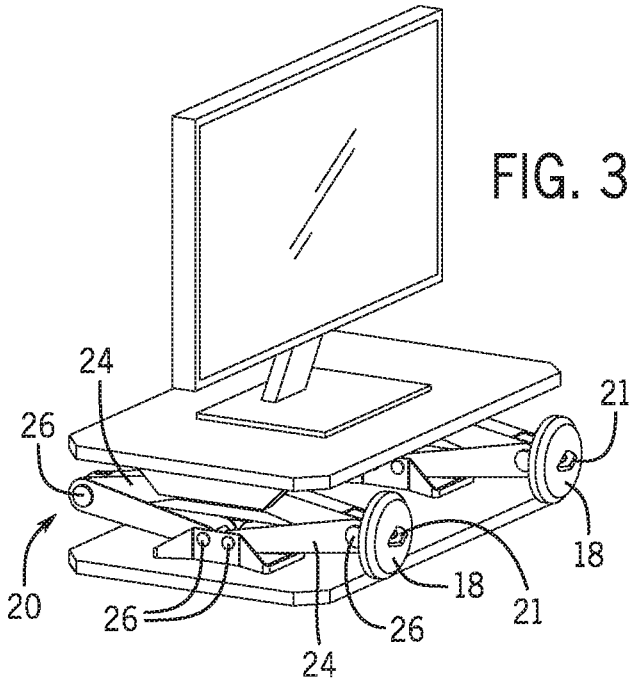
FIG. 3 is a side perspective view showing the therapy desk desktop in a lowered position.
Figure 4:
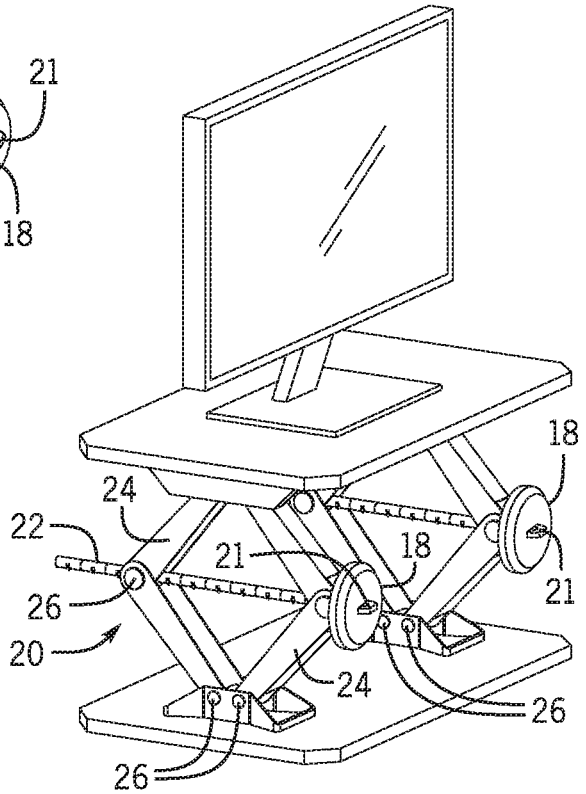
FIG. 4 is a side perspective view showing the same at an intermediate position raised manually or power drive attachment.
Figure 5:
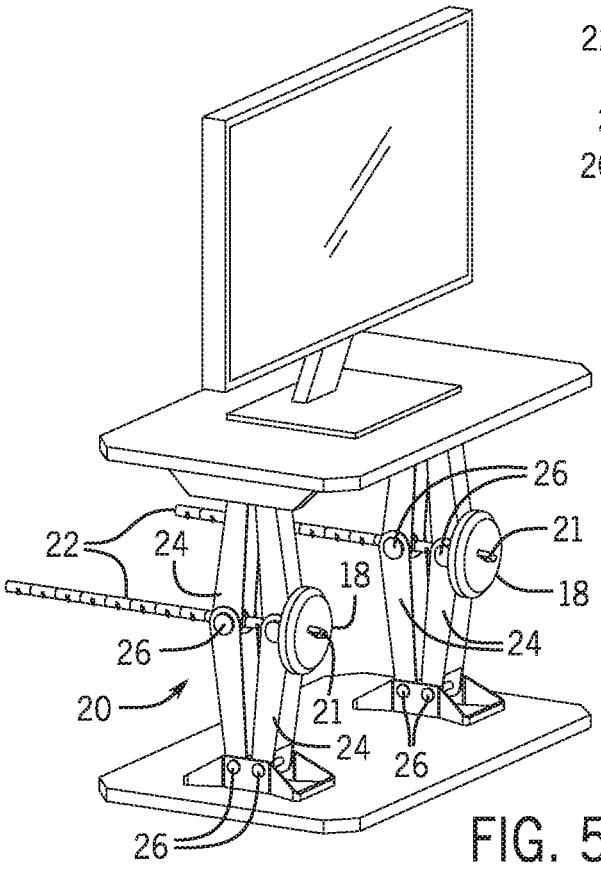
FIG. 5 is a side perspective view showing the same at a maximum elevated position raised manually or power drive mechanism.
Figure 7:
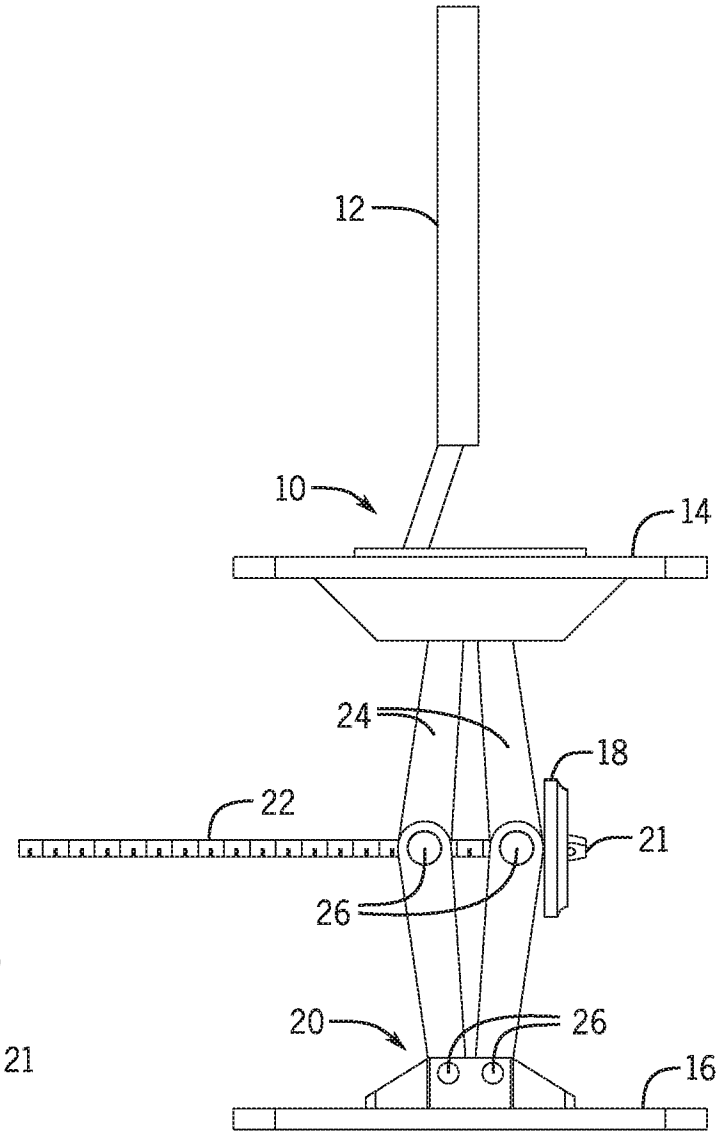
FIG. 7 is a side elevation view of the same shown at a maximum elevated position raised manually or power drive attachment.
Figure 6:
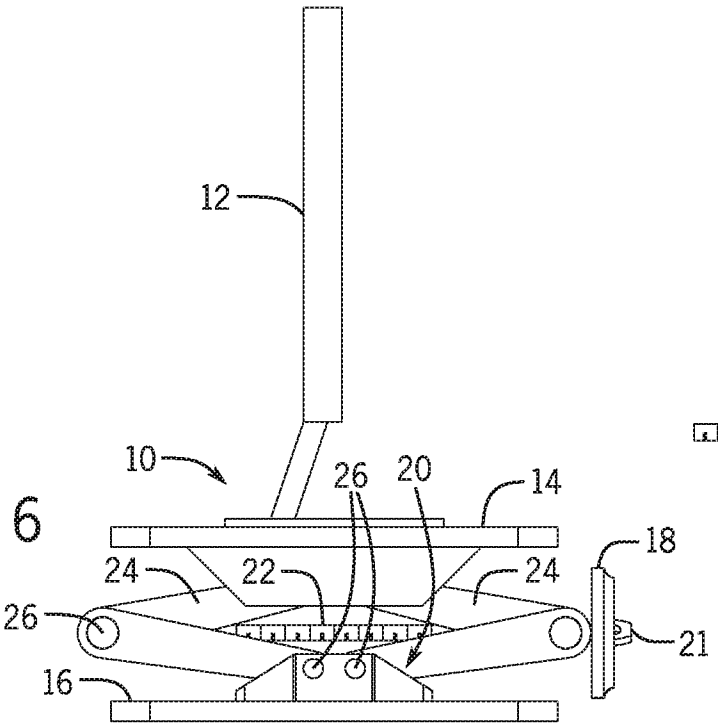
FIG. 6 is a side elevation view of the therapy desk desktop shown in a lowered position.

The following detailed description set forth is the best currently contemplated modes of carrying out exemplary embodiments of the invention. The description is not to be taken in a limiting sense, but is made merely for the purpose of illustrating the general principles of the invention.

Broadly, embodiments of the present invention provide a truly vertically adjustable desk and desktop that provides therapeutic benefits for a user's fingers, wrists, and hands, back and leg while avoiding any strain to the back.

As seen in reference to the drawings of FIGS. 1-12, the therapeutic desktop 10 of the present invention may be utilized to support one or more monitors 12 on a desktop surface 14. During manual, therapeutic operation, the desktop surface 14 may be elevated from a base 16, by operation of an elevation knob 18. Rotation of the elevation knob 18 operates an elevation mechanism 20, such as a scissors jack. The gripping and rotation of the elevation knob 18 provides therapeutic benefits for a user's fingers, wrists, and hands, while avoiding lifting strain on the back to elevate or lower the desktop surface 14 as all the operations are performed while seated.

When manual operation of the desktop 10 is not desired for whatever reason, such as poor or hampered wrist, carpel tunnel syndrome, or to accommodate special uses, the elevation mechanism 20, may also be configured for motorized operation. In this instance a coupling 21 may be provided without the elevation knob 18. The coupling 21 permits interconnection with a rotary drive unit 30, such as a cordless screwdriver equipped with a bit 28 that engages with the coupling 21.

In operation, rotation of the elevation knob 18 turns a worm screw 22. The worm screw 22 engages with a threaded joint 26 interconnecting the legs 24 of the elevation mechanism 20. The threaded joints 26 are drawn along the worm screw 22, and the legs 24 rotate about pivots 27 at the opposite base of the legs 24 coupling the legs to an elevation base and an elevation platform. Thus, simply be sitting comfortably on a chair and without straining the back the elevation knobs 18 are rotated clockwise or anticlockwise to raise or lower the monitor shelf 14 with infinite increments of adjustment without any chance of the monitor 12 tipping over.

In certain embodiments, a keyboard support 40 may also be provided. The keyboard support 40 may include a working surface to support a computing keyboard. A mouse surface may also be provided. The keyboard support 40 may include adjustable legs 42 to selectively raise and lower the keyboard support 40 independent of the monitor support.

In certain embodiments, a separate peddling device to exercise the legs may be utilized while working in a seated position. In conclusion, therapy desk and desk tops are devices that provide true therapy and exceptional health benefits while working sitting down or standing up. The user with wrist injuries or weakness or having carpel tunnel syndrome can also buy the power drive attachment to raise or lower the monitor.

Figure 9:
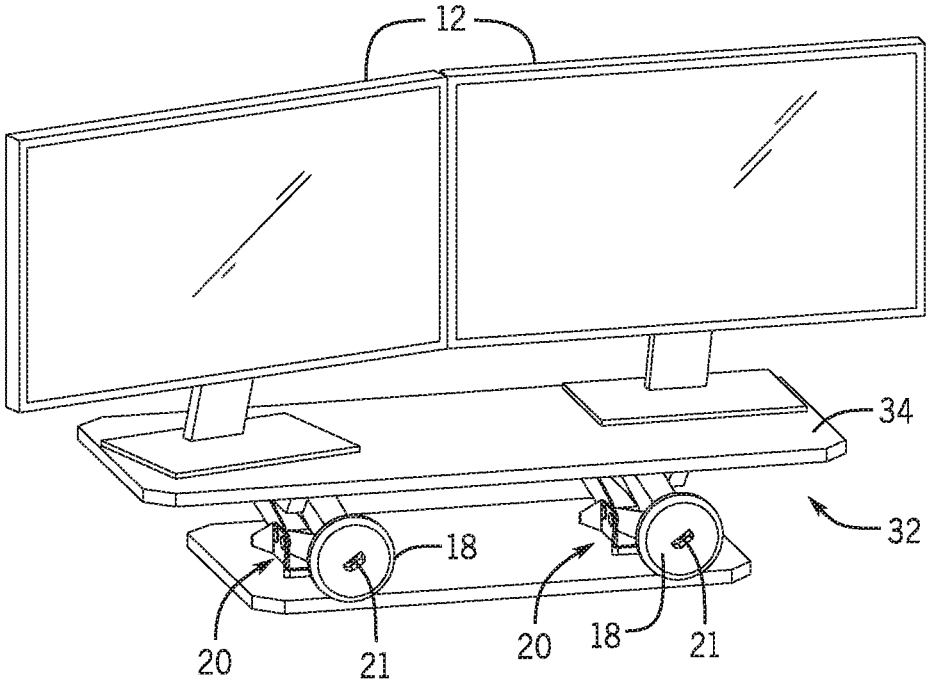
FIG. 9 is a front perspective view showing an embodiment of the therapy desk desktop supporting two monitors without additional monitor stand.
Figure 10:
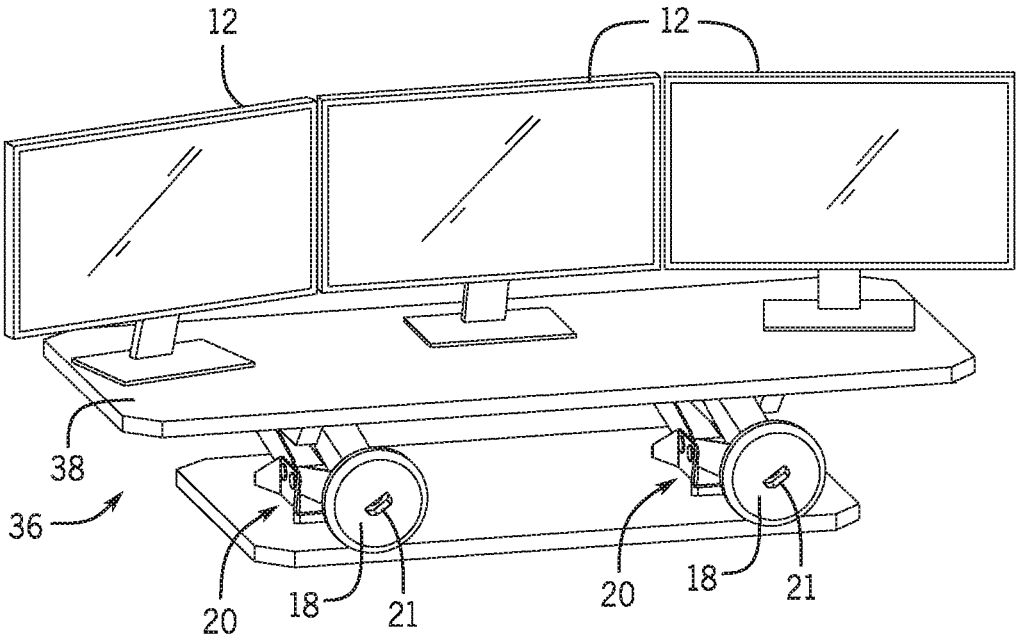
FIG. 10 is a front perspective view showing an embodiment of the therapy desk desktop supporting three monitors also without additional monitor stand.
Figure 12:
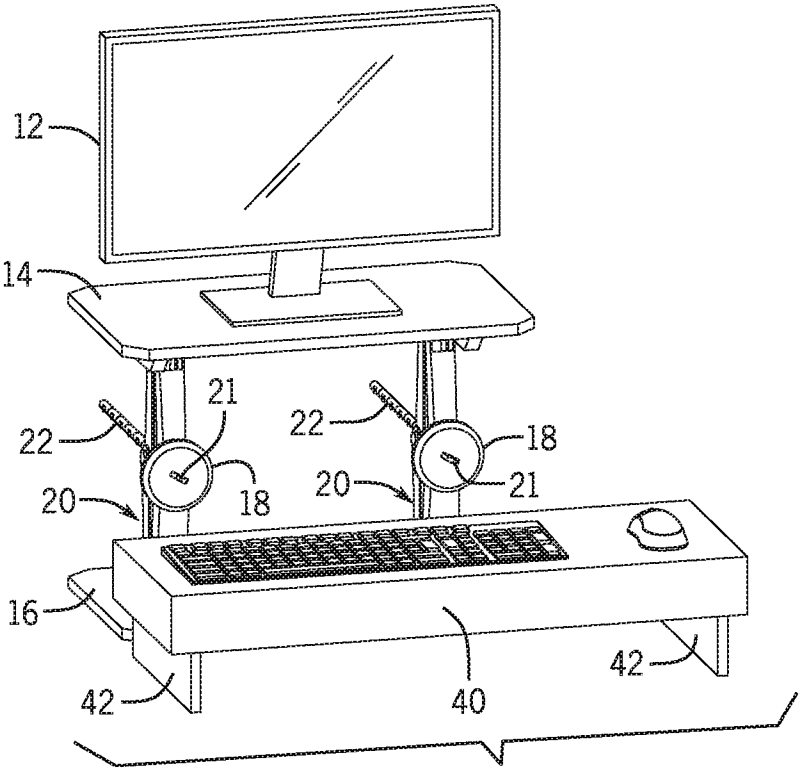
FIG. 12 is a front perspective view of the same in an elevated position and a keyboard station also in an elevated position both raised individually and independently by the user suited to their individual height and comfort level.
Figure 11:
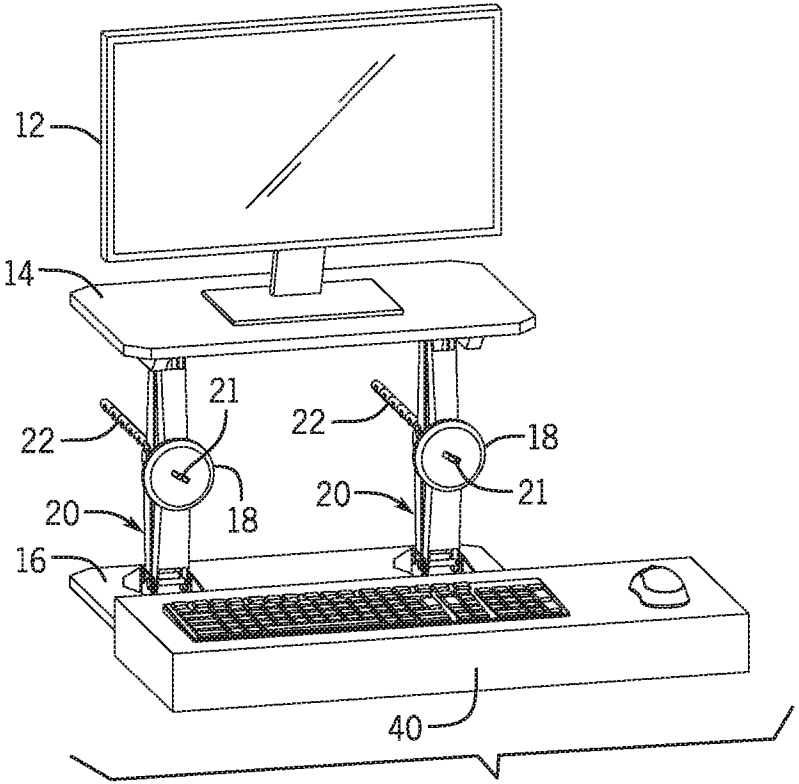
FIG. 11 is a front perspective view of the therapy desk desktop in an elevated position and a detached keyboard station in a lowered position.

In some embodiments a dual monitor therapy desk top 32 may include a wider desktop surface 34 to accommodate two monitors 12. In yet other embodiments, a triple monitor therapy desk 36 with an even wider desktop surface 34, to accommodate supporting three monitors 12. In all embodiments, additional add-on monitor support brackets are not needed as required by the prior arts. In these embodiments the elevation mechanism 20 and elevation knobs 18 may always be positioned in front of the operator so that they may easily reach and operate the elevation knobs or the power drive. All three therapy desktops as shown in FIG. 1, FIG. 9, and FIG. 10 are less than 12" inch wide, allowing more than 18" inches of deskspace of a typical 30" inch desk available for work. It's not available by the prior arts.

Figure 8:
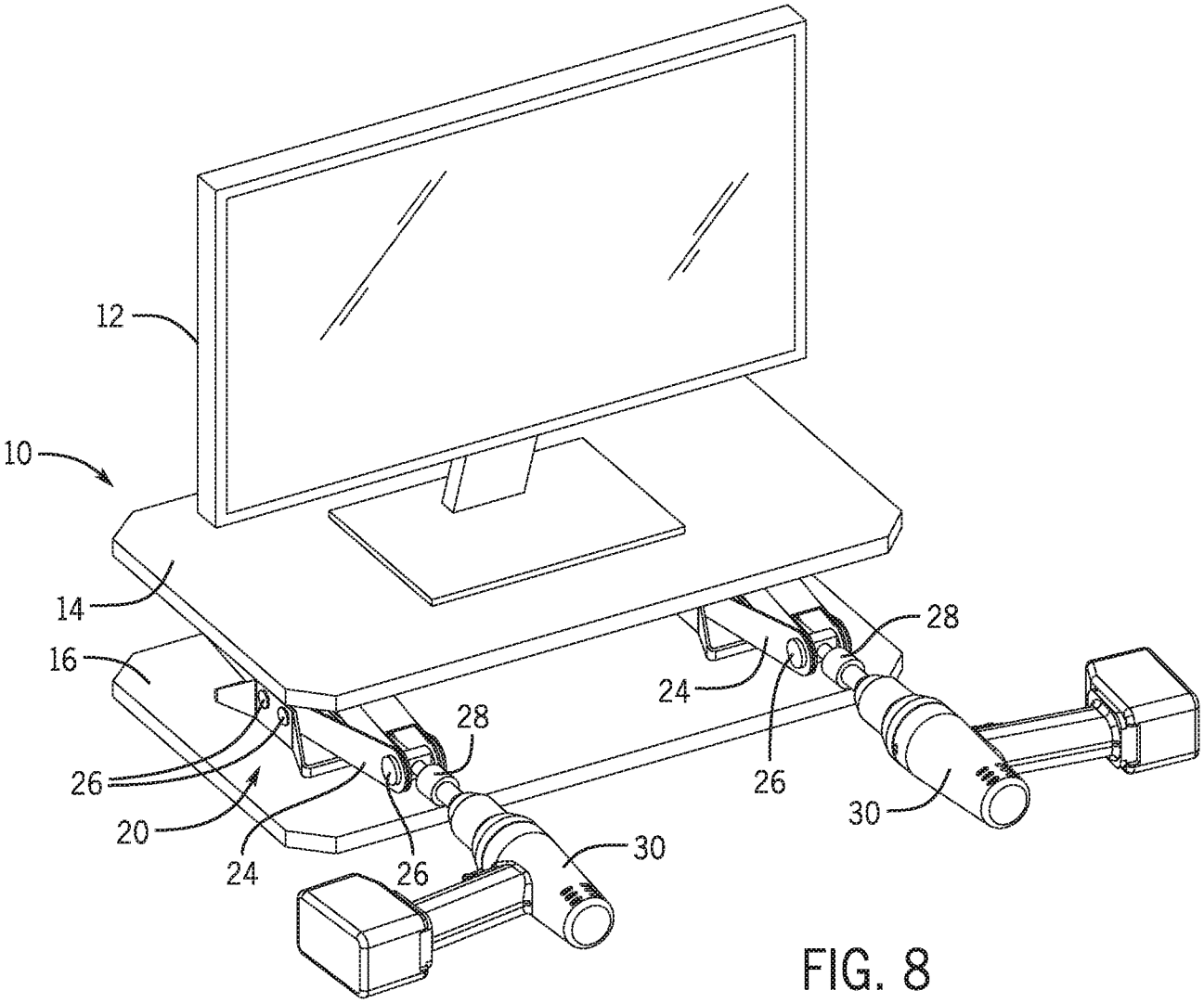
FIG. 8 is front perspective view showing an automated power driven elevation mechanism of the therapy desk desktop.
Figure 13:
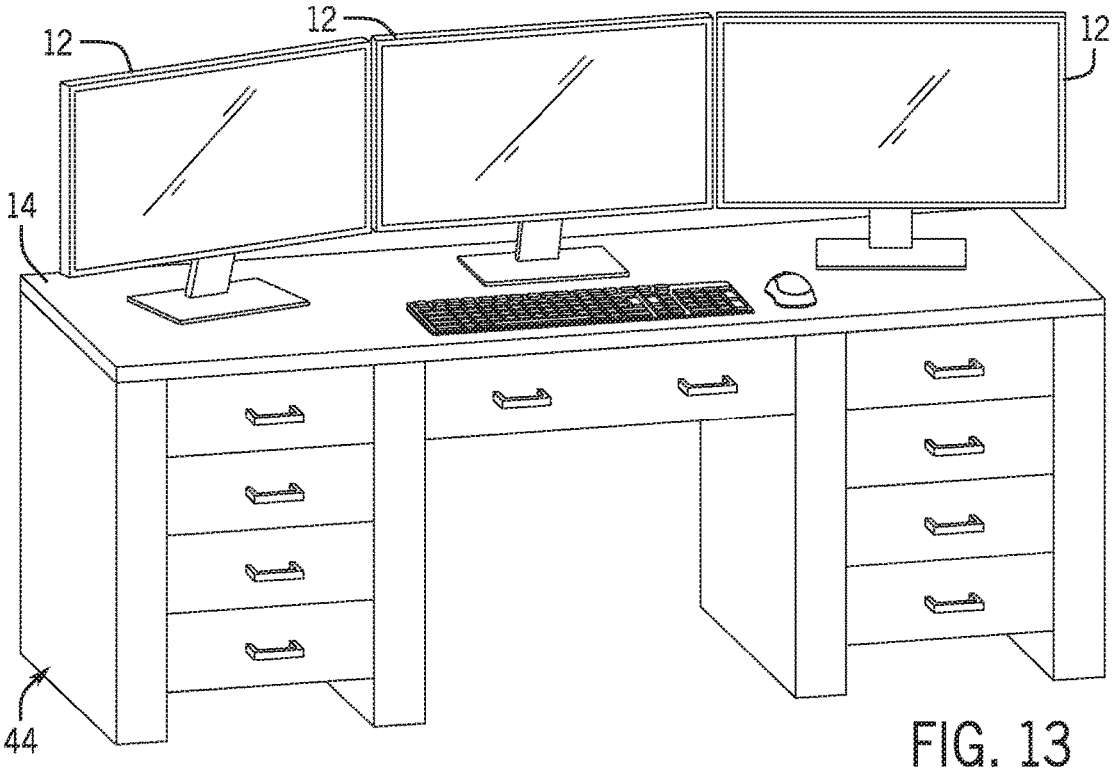
FIG. 13 is a front view of a typical double pedestal knee hole desk with the therapy desk mechanism installed inside and attached to bottom of the desk surface in a lowered position.
Figure 14:
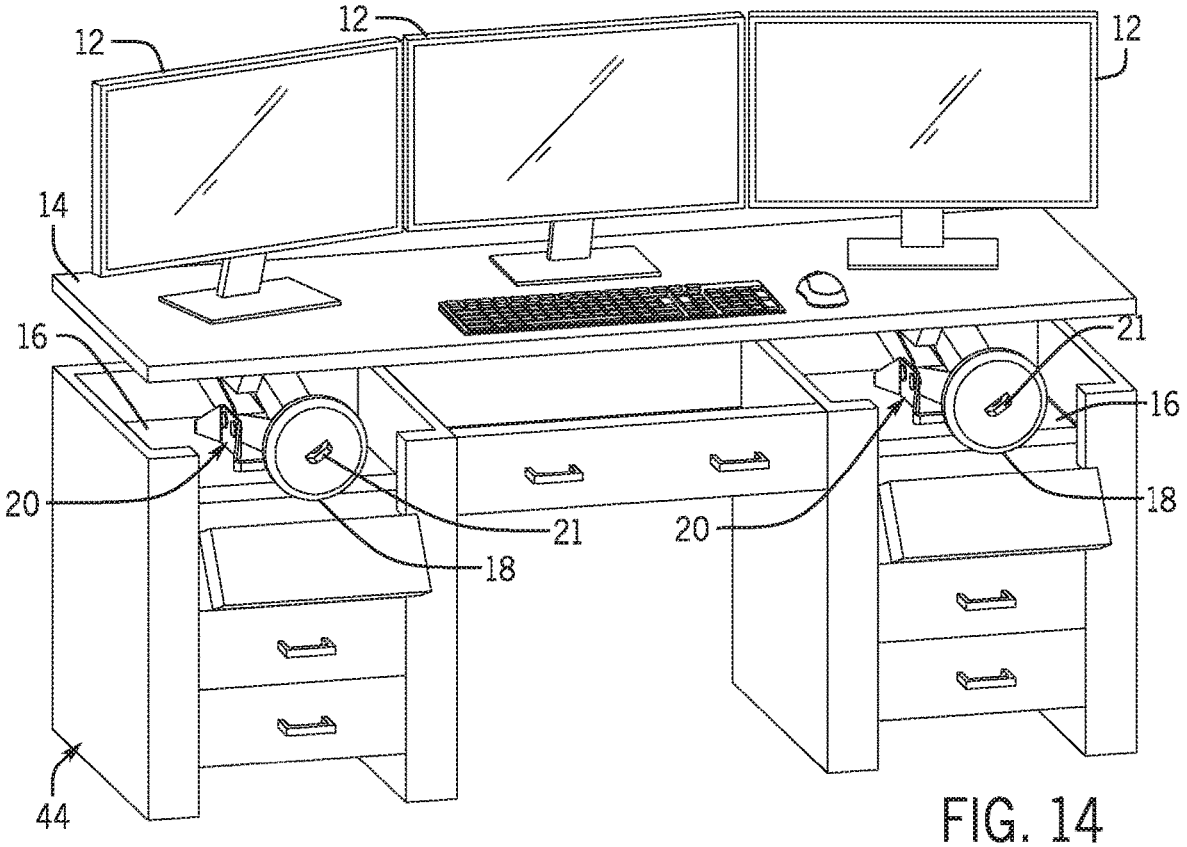
FIG. 14 is a front view of the same pedestal desk with the top surface of the desk in an elevated position using the therapy desk mechanism either manually or with the power drive attachment.

As seen in reference to FIGS. 13 and 14, in some embodiments, the therapeutic desktop may also include a desk pedestal 44 having a left drawer structure and a right drawer structure. The desktop 14 has a workspace that supports one or more monitors 12, a keyboard, and a mouse or other input device. The elevation mechanism 20 is carried within a top drawer cavity of the desk pedestal 44. A faceplate of the top drawer cavity is selectively positioned to access or conceal the elevation mechanism 20. The elevation knobs 18 are disposed such that a user can reach each elevation knob while positioned in front of the therapeutic desktop 14. The cordless rechargeable power drive as shown in FIG. 8 can be used if desired to raise or lower the entire desk surface. It should be noted that what is shown in FIG. 14 can be made available in kit form to be assembled by the end user and/or modify an existing knee hole desk belonging to the end user.

Figure 16:
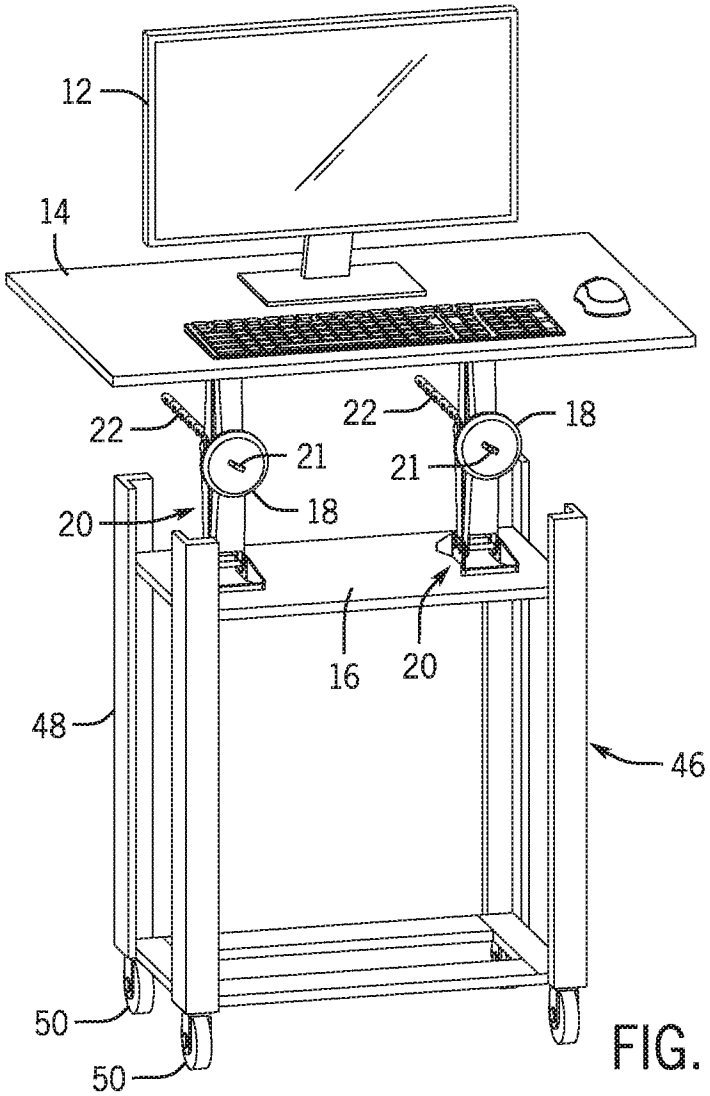
FIG. 16 is a front view of the same with the top surface of the desk in an elevated position with therapy desk mechanism either manually or with the power drive attachment.
Figure 15:
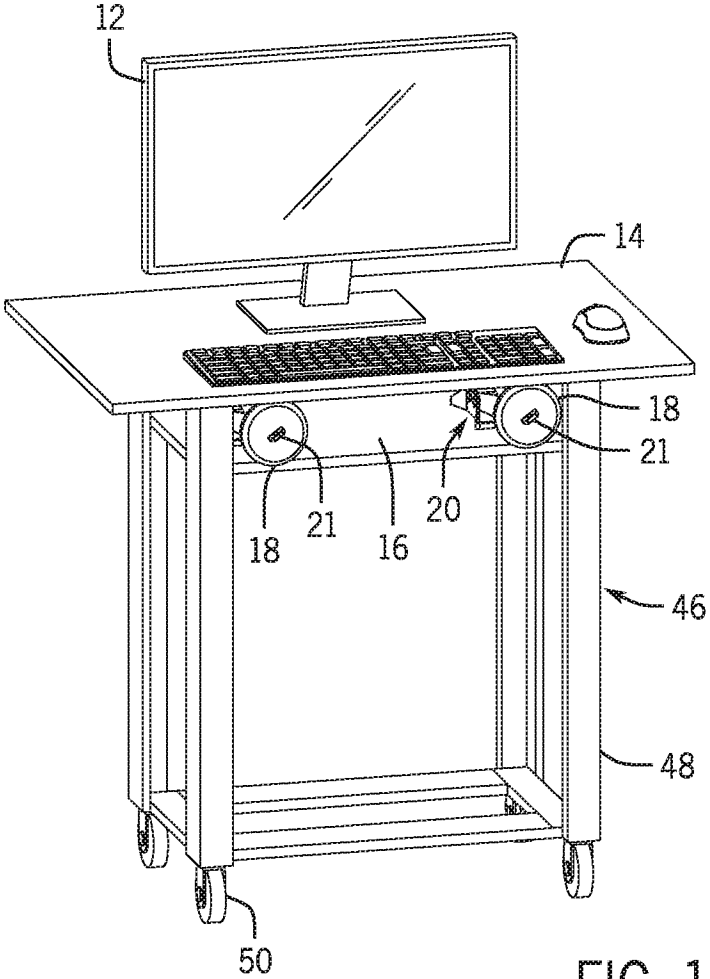
FIG. 15 is a front view of a pedestal desk with wheels allowing it to be rolled around with the therapy desk mechanism permanently installed inside and attached to the bottom of the desk surface in a lowered position.

As seen in reference to FIGS. 15 and 16, the therapeutic desktop may also include a stand 46 having a plurality of upright frame members 48. A base section interconnects the plurality of upright frame members 48. A platform 16 interconnects the plurality of upright frame members 48 below a top end of the plurality of upright frame members 48. The elevation mechanism 20 is carried by the platform 16 and the desktop surface 14 rests upon the ends of the plurality of upright frame members 48 with the elevation mechanism 20 in a lowered position. The stand 46 may also include a ground wheel attached to the plurality of upright frame members 48 to provide mobility in any direction. The cordless rechargeable power drive as shown in FIG. 8 can be used if desired to raise or lower the entire desk surface. It should be noted that what is shown in FIG. 16 can be made available in kit form to be assembled by the end user.

It should be specifically understood, that the foregoing relates to exemplary embodiments of the invention and that modifications may be made without departing from the spirit and scope of the invention as set forth in the following claims.

What is claimed is:

1. A therapeutic desktop, for supporting one or more monitors, comprising:

a desktop surface for supporting the one or more monitors;

an elevation mechanism supporting a left side and a right side of the desktop surface; and an elevation knob connected to the elevation mechanism, the elevation knob is rotatable by a user's hand to selectively elevate or lower the elevation mechanism in infinite increments;

a desk pedestal having a left drawer structure and a right drawer structure; and the elevation mechanism is carried within a top drawer cavity of the desk pedestal, wherein the desktop surface is useable at each position between an elevated position and a lowered position.

2. The therapeutic desktop of claim 1, wherein the elevation mechanism comprises:

a scissors assembly having a base disposed for contact with a support surface, and top connector connecting the scissors assembly to a bottom face of the desktop surface, wherein the elevation knob is connected to a worm screw of the scissors assembly.

3. The therapeutic desktop of claim 2, wherein the scissors assembly further comprises:

a pair of opposed lower legs having a first end pivotally attached to the base;

a pair of opposed upper legs having a first end pivotally connected a bottom of the desktop surface;

a joint to pivotally connect a second end of the pair of opposed lower legs with a corresponding second end of the pair of opposed upper legs; and a threaded aperture in the joint, wherein the worm screw is received in the threaded aperture.

4. The therapeutic desktop of claim 3, wherein rotation of the elevation knob rotates the worm screw to selectively draw or extend the joints together or away from each other.

5. The therapeutic desktop of claim 4, further comprising:

a coupler on the elevation knob, configured to connect with a hand held rotary drive motor(s).

6. The therapeutic desktop of claim 1, further comprising:

a keyboard support providing an upper working surface to support a computing keyboard, wherein the working surface elevated by a side edge.

7. The therapeutic desktop of claim 6, wherein the working surface further comprises a mouse surface.

8. The therapeutic desktop of claim 6, further comprising adjustable legs to selectively raise and lower the keyboard support.

9. The therapeutic desktop of claim 1, wherein a faceplate of the top drawer cavity is selectively positioned to access or conceal the elevation mechanisms.

10. The therapeutic desktop of claim 1, wherein the elevation knobs are disposed such that a user can reach each elevation knob while positioned in front of the therapeutic desktop.

11. The therapeutic desktop of claim 1, further comprising:

a ground wheel attached to the pedestal to enable mobility in any direction.

* * * * *